US005639217A

United States Patent [19]

Ohtsuki et al.

[11] Patent Number: 5,639,217

[45] Date of Patent: Jun. 17, 1997

[54] SPLITTER-TYPE IMPELLER

[75] Inventors: Yukio Ohtsuki, Kobe; Akio Onzuka, Akashi, both of Japan

[73] Assignee: Kawasaki Jukogyo Kabushiki Kaisha, Hyogo-Ken, Japan

[21] Appl. No.: 600,178

[22] Filed: Feb. 12, 1996

[51] Int. Cl.[6] ..... F04D 29/38

[52] U.S. Cl. ..... 416/183; 416/188

[58] Field of Search ..... 416/183, 185, 416/188

[56] References Cited

U.S. PATENT DOCUMENTS

| | | | |
|---|---|---|---|
| 3,627,447 | 12/1971 | Okaduu | 416/183 |
| 4,093,401 | 6/1978 | Gravelle | 416/188 |

FOREIGN PATENT DOCUMENTS

| | | | |
|---|---|---|---|
| 0173596 | 10/1982 | Japan | 416/183 |
| 0170899 | 10/1983 | Japan | 416/188 |
| 0122201 | 6/1985 | Japan | 416/188 |
| 90/02265 | 3/1990 | WIPO | 416/183 |

*Primary Examiner*—Edward K. Look
*Assistant Examiner*—Mark Sgantzos
*Attorney, Agent, or Firm*—Oliff & Berridge

[57] ABSTRACT

A splitter-type impeller comprises a rotary disc member having a central hole to which a hub is fitted with a rotation shaft, a plurality of full blades disposed on one surface of the disc member, each of the full blades having a front edge portion positioned near an outer peripheral portion of the hub, a rear edge portion positioned near an outer peripheral portion of the disc member and a protruded intermediate portion so as to provide a curved shape, and a plurality of splitter blades disposed on the one surface of the disc member, each of the splitter blades having a front edge portion positioned backward of the front edge portion of the full blade in an axial direction of the disc member, a rear edge portion positioned near the outer peripheral portion of the disc member and a protruded intermediate portion so as to provide a curved shape in parallel to the full blade. The splitter blades and the full blades are alternately arranged with equal spaces along a rotating direction of the disc member, and each of the splitter blade has an extension blade formed integrally with the protruded intermediate portion of the splitter blade in a rectangular shape having an edge portion inclining from a corner portion of the protruded intermediate portion near the front edge portion of the splitter blade to a portion near the outer peripheral portion of the hub.

2 Claims, 5 Drawing Sheets

SPLITTER-TYPE IMPELLER

BACKGROUND OF THE INVENTION

The present invention relates to a splitter-type impeller, for example, provided for an inlet portion of a gas turbine to raise a pressure of a gas such as air, particularly, for guiding a gas sucked from a central side of the gas turbine by rotation of a turbine driving shaft to an outer peripheral side thereof and discharging it outward.

In a gas turbine, an air is compressed by a compressor coaxially disposed to a turbine driving shaft, and the compressed air is mixed with a fuel and burnt in a combustor to thereby obtain a gas of high temperature and high pressure. The obtained gas is then introduced into turbines and causes a driving force to rotate the turbines at a high speed. And the turbines are mounted to the turbine driving shaft (rotation shaft).

In general, for the impeller of this kind, it is required to ensure sufficiently large gas inlet area with the most effective number of blades in the whole impeller, not to cause a gas turbulent flow due to rapid change of the gas flow area and not to cause an efficiency loss due to rapid change of gas flow resistance.

FIG. 5 shows a general splitter-type impeller to be applied to a gas turbine, for example. Referring to FIG. 5, the impeller is provided with a rotary disc 2 having, at its central portion, a hub 1 for attaching the impeller to a rotation shaft, i.e turbine driving shaft, of a gas turbine. A plurality of full blades 3 and splitter blades 4 are disposed and fixed on one surface side portion of the rotary disc 2 alternately with predetermined spaces with each other along the rotating direction of the disc 2 in such a manner as that the full blades 3 and the splitter blades 4 provide curved shapes so that they are displaced more largely towards rotating direction at the outer peripheral side of the disc along its rotating direction.

As shown in FIG. 5 and FIG. 6, such full blades 3 and the splitter blades 4 have rear side edges **3*b* and 4*b* which are positioned to the outer peripheral edge sides 2*a* of the rotary disc 2. The full blades 3 have front side edges 3*a* positioned at portions near the outer peripheral surface of the hub 1 and the splitter blades 4 have front side edges 4*a* positioned slightly backward of the front side edges 3*a* of the full blades 3** in an axial direction.

The conventional splitter-type impeller of the structure described above and shown in FIG. 5 has an arrangement, as shown in FIG. 7, in which a gas inlet portion 5 is formed between the adjacent two full blades 3 with one splitter blade 4 interposed therebetween, so that sufficiently large inlet area is ensured. However, in such arrangement, an area of a gas flow passage 6, formed between the full blade 3 and the splitter blade 4, connected to the inlet portion 5 rapidly changes, likely causing a turbulent flow of the gas and causing gas flow loss due to a resistance of the passage, thus being inefficient.

FIGS. 8A, 8B and 9A, 9B represent modifications of such arrangement of the full blades 3 and the splitter blades 4. In the modification of FIGS. 8A and 8B, these blades are all formed as full blades 3 and the front side edge portions of such full blades 3 are cut off to provide cut-back portions 7 substantially in a triangular shape shown by dotted lines therein. In the modification of FIGS. 9A and 9B, the full blades 3 and the splitter blades 4 are alternately arranged along the disc rotating direction and only the full blades 3 are cut off to provide cut-back portions 7 substantially in a triangular shape shown by dotted lines.

According to the modification of FIGS. 8A, 8B the change of the flow area is made gentle to reduce the causing of the turbulent flow of the gas. However, in a case where the total number of the blades is made same as that shown in FIGS. 5 to 7, it is difficult to sufficiently ensure the area of the gas inlet portion 5 between the adjacent blades 3 in a view point of keeping operational efficiency of the whole impellers.

On the other hand, according to the modification of FIGS. 9A, 9B it is possible to ensure the sufficiently large area of the inlet portion 5. However, the area largely changes from the inlet portion 5 to the front end portion of the gas flow passage 6, resulting in the rapid change of the flow resistance, being inefficient.

As described above, for the impeller of this kind, it is generally required to ensure sufficiently large gas inlet area with the most effective number of blades in the whole impeller, not to cause a gas turbulent flow due to rapid change of the flow area and not to cause an efficiency loss due to rapid change of flow resistance. However, in the conventional impellers of the structures described above, there is provided no impeller sufficiently attaining all these functions, such as one function being attained, the other function being damaged.

SUMMARY OF THE INVENTION

An object of the present invention is to substantially eliminate defects or drawbacks encountered in the prior art described above and to provide a splitter-type impeller of, for example, a gas turbine, capable of ensuring a sufficient gas inlet area with most effective number of blades and suppressing efficiency loss due to rapid changes of the inlet area and flow resistance, thus improving an operational efficiency.

This and other objects can be achieved according to the present invention by providing a splitter-type impeller comprising:

- a rotary disc member having a central hole with which hub is fitted to a rotation shaft;
- a plurality of full blades disposed on one surface of the disc member, each of the full blades having a front edge portion positioned near an outer peripheral portion of the hub, a rear edge portion positioned near an outer peripheral portion of the disc member and a protruded intermediate portion connecting the front and rear edge portions of the full blade so as to provide a curved shape; and
- a plurality of splitter blades disposed on the one surface of the disc member, each of the splitter blades having a front edge portion positioned backward of the front edge portion of the full blade in a axial direction of the disc member, a rear edge portion positioned near the outer peripheral portion of the disc member and a protruded intermediate portion connecting the front and rear edge portions of the splitter blade, the splitter blades and the full blades being alternately arranged with substantially equal spaces along a rotating direction of the disc member,
- wherein each of the splitter blade has an extension blade formed integrally with the protruded intermediate portion of the splitter blade having an edge portion inclining from a top of the protruded intermediate portion near the front edge portion of the splitter blade to a portion near the outer peripheral portion of the hub.

According to the structure of the splitter-type blade of the present invention, the number of the blades to be mounted to the rotary disc member are maintained so as not to reduce an operational efficiency of the gas flow passage caused by an abnormal increasing of flow resistance at portions between the full and splitter blades. In addition, the gas inlet portion is formed between the adjacent two full blades with the splitter blade interposed therebetween to sufficiently ensure the gas inlet area. Furthermore, the splitter blade has the inclining edge portion at substantially the central portion of the inlet area to thereby make gentle the change of the gas inlet area and reduce the operational loss due to the rapid change of the flow resistance. Accordingly, the operational efficiency of the gas turbine can be improved in various view points such as the gas flow amount, the gas flow resistance and the like.

The nature and further features of the present invention will be made more clear from the following descriptions made with reference to the accompanying drawings.

DESCRIPTION OF THE PREFERRED EMBODIMENTS

Figure 1:
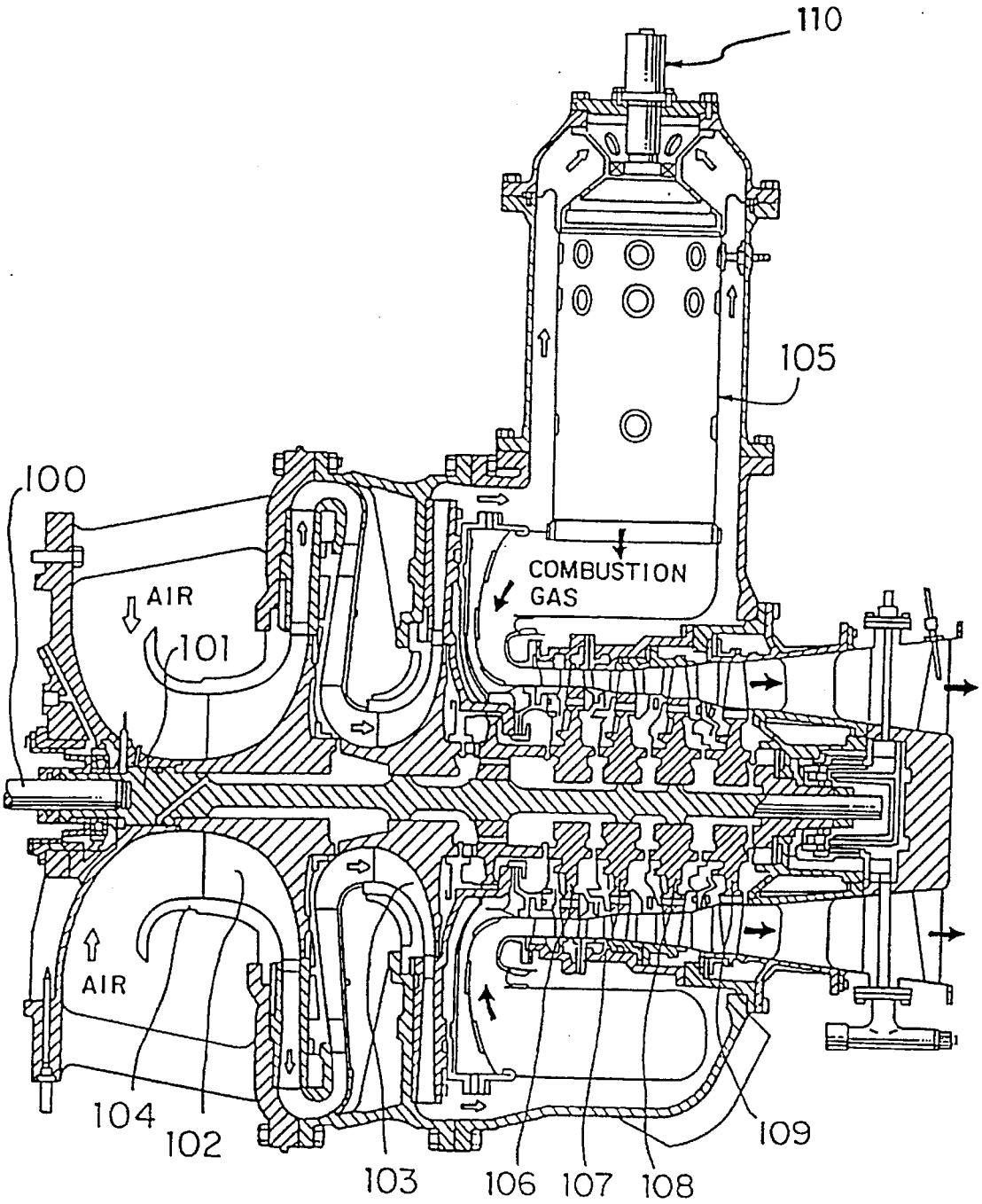
FIG. 1 is a longitudinal sectional view of one kind of an entire gas turbine to which an impeller of the present invention is applicable.

FIG. 1 is a longitudinal sectional view of one example of an entire gas turbine to which a present invention is applicable. Referring to FIG. 1, reference numeral 100 denotes a coupling shaft operatively connected to a turbine driving means (not shown) and the coupling shaft 100 is coupled to a turbine driving shaft 101 extending longitudinal at substantially central portion of a turbine system. In this example, impeller device including a first stage impeller 102 and a second stage impeller 103 is mounted on the turbine shaft 101. In FIG. 1, white arrows represent the flow of air and black arrows represents the flow of combustion gas. The air is introduced through an air intake 104 and, after that the air is introduced into a combustion chamber 105 into which a fuel is injected through a fuel injection member 110. The fuel mixed with the compressed air in the combustion chamber 105 is burnt therein and the combustion gas is introduced into the turbines 106, 107, 108 and 109 and causes a driving force to rotate the turbines at a high speed. According to this manner, the gas turbine is driven.

Figure 2:
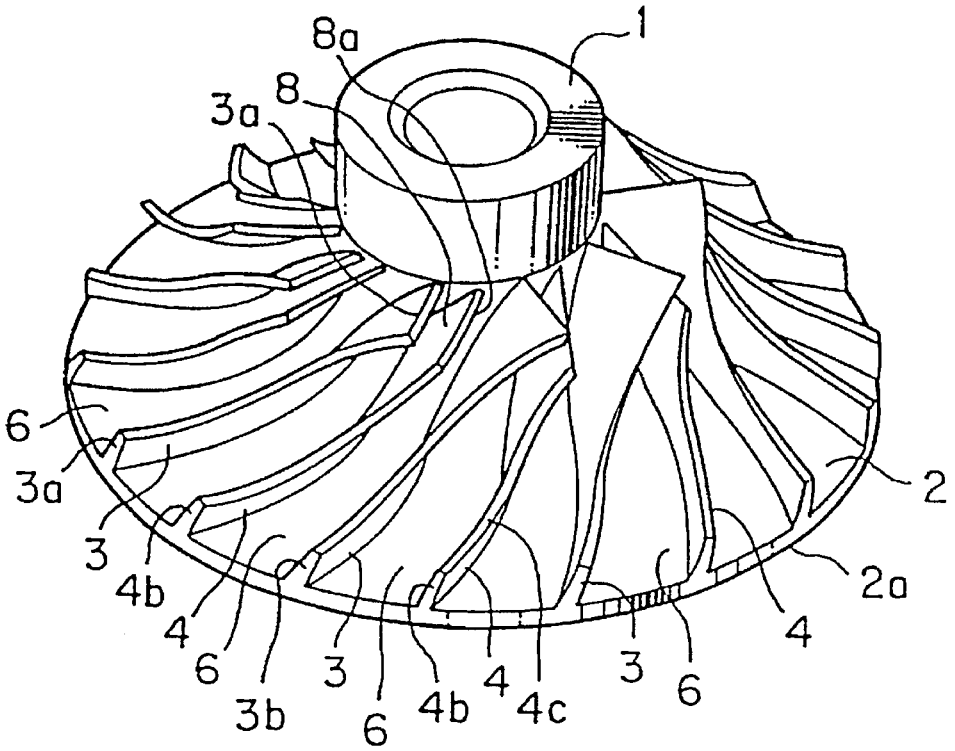
FIG. 2 is a perspective view of a splitter-type impeller according to the present invention.

FIG. 2 is a perspective view of an embodiment of an impeller, according to the present invention, which is applicable of the impeller 102 or 103 mentioned above.

Figure 3:
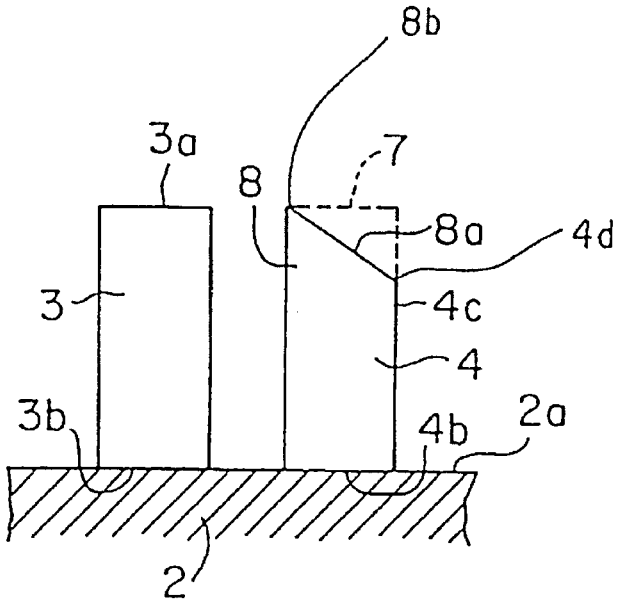
FIG. 3 is a view partially showing an arrangement of a full blade and a splitter blade of the impeller shown in FIG. 2.

Referring to FIG. 2, the impeller is provided with a rotary disc 2 having, at its central portion, a hub 1 for attaching the impeller to the rotation shaft, i.e turbine driving shaft, of a gas turbine. A plurality of full blades 3 and splitter blades 4 are disposed and fixed on one surface side portion of the rotary disc 2 alternately with predetermined spaces with each other along the rotating direction of the disc 2. In this embodiment, as shown in FIG. 3, in comparison with a conventional impeller such as that shown in FIG. 5, extension blade portions 8, each substantially in triangular shape, are further integrally formed with the front end portions of the splitter blades 4, respectively. Each of these extension blade portions 8 is provided with an edge portion 8*a* inclining from a top 4*d* of a protruded intermediate portion 4*c* connecting the front and rear edge portions of the splitter blade 4 to a portion near the outer peripheral portion 8*b* of the hub 1 to be mounted to the rotation shaft of the gas turbine. That is, the splitter blade 4 is formed so as to have a shape identical to the full blade adjacent to the splitter blade 4 and having a triangular cut back portion 7 of the front end portion as explained with reference to FIG. 3.

Figure 4:
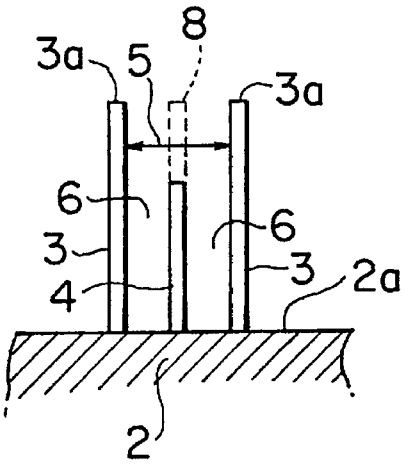
FIG. 4 is a schematic front view of portions of the blades of FIG. 3.
Figure 5:
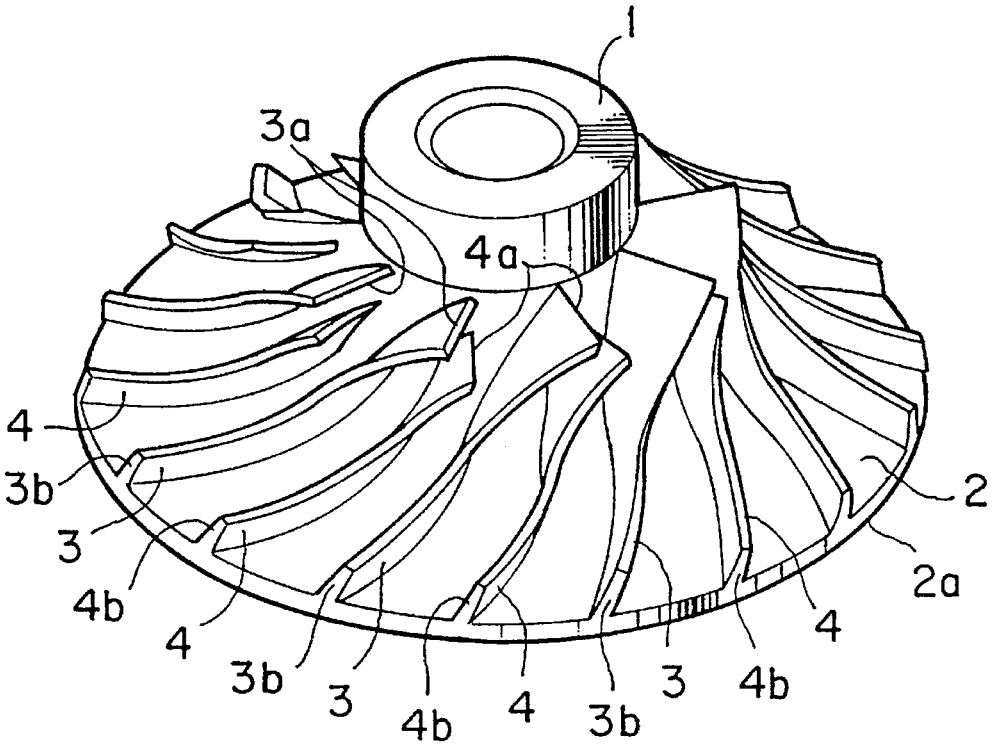
FIG. 5 PRIOR ART
FIG. 5 is a perspective view of a conventional splitter-type impeller.
Figure 6:
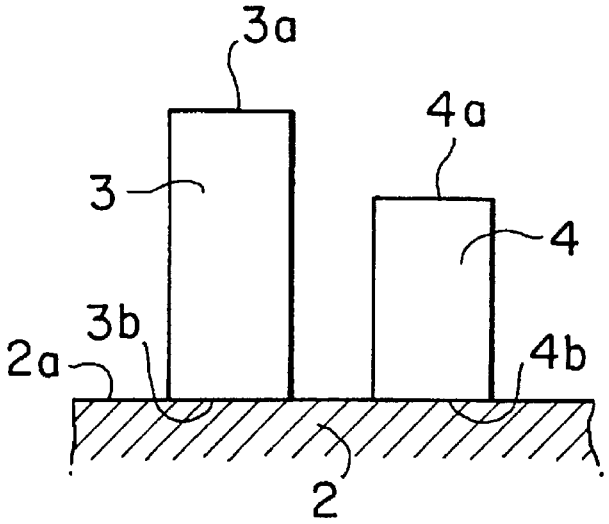
FIG. 6 PRIOR ART
FIG. 6 is a view partially showing an arrangement of a full blade and a splitter blade of the impeller shown in FIG. 5.
Figure 7:
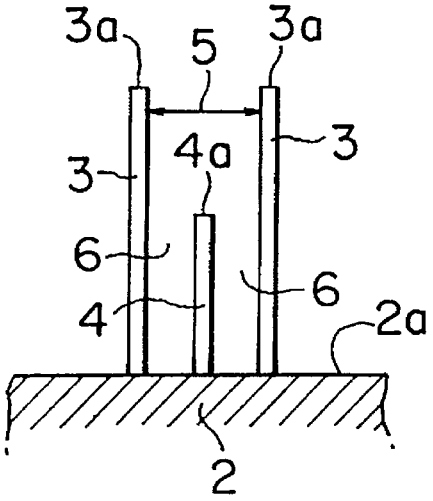
FIG. 7 PRIOR ART
FIG. 7 is a schematic front view of portions of the blades of FIG. 5.
Figure 8A:
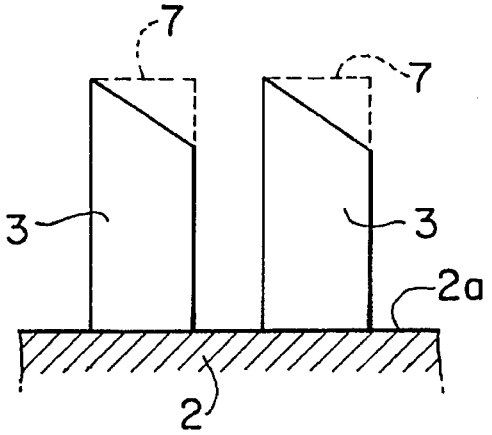
FIG. 8A PRIOR ART
FIG. 8A is a brief view showing an arrangement of a full blade of one example with a conventional structure.
Figure 8B:
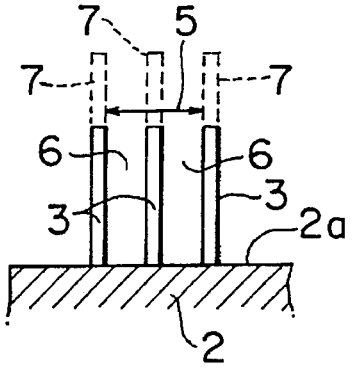
FIG. 8B PRIOR ART
FIG. 8B is a schematic front view of the portions of FIG. 8A.
Figure 9A:
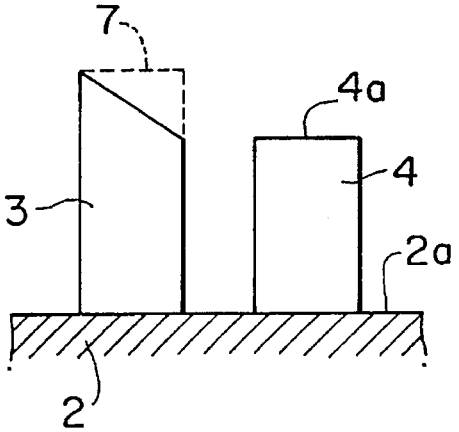
FIG. 9A PRIOR ART
FIG. 9A is a brief view showing an arrangement of a full blade and a splitter blade of another example with a conventional structure.
Figure 9B:
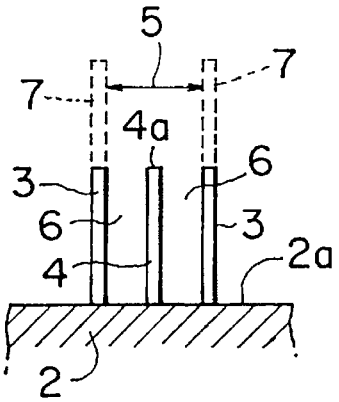
FIG. 9B PRIOR ART
FIG. 9B is a schematic front view of the portions of FIG. 9A.

Referring to FIG. 4, according to the structure of the impeller of the present embodiment, a gas inlet portion 5 for the gas formed in the vicinity of the outer peripheral portion of the hub 1 is formed between the adjacent full blades 3, positioned on both the sides of the splitter blade 4 having such inclining edge portion 8*a*, so that a sufficient area for the gas inlet portion 5 can be ensured. Accordingly, the area continuous from the inlet portion 5 to the gas flow passage 6 between the blades 3 and 4 adjacent to each other in the impeller rotating direction gently changes because of the location of the triangular extension blade 8 formed to the splitter blade 4, thereby suppressing the turbulent flow of the gas, and in addition, the flow resistance is gradually increased, thereby suppressing the increasing of the loss of the rapid change increasing of the flow resistance. Accordingly, a large area of the inlet portion 5 can be ensured with the distance between the adjacent blades maintained to the most effective value for the impeller of this kind in addition to the suppressing of the loss due to the turbulent flow of the gas and the rapid change of the flow resistance, thus effectively improving the entire operational efficiency of the impeller, which is not expected from the shape of a conventional impeller such as shown in FIG. 5.

What is claimed is:

1. A splitter-type impeller comprising:

a rotary disc member having a central hole with which a hub is fitted to a rotation shaft;

a plurality of full blades disposed on one surface of the disc member, each of said full blade having a front edge portion positioned near an outer peripheral portion of the hub, a rear edge portion positioned near an outer peripheral portion of the disc member and a protruded intermediate portion connecting to the front and rear edge portions of the full blade so as to provide a curved shape; and a plurality of splitter blades disposed on the one surface of the disc member, each of said splitter blades having a front edge portion positioned backward of the front edge portion of the full blade in an axial direction of the disc member, a rear edge portion positioned near the outer peripheral portion of the disc member and a protruded intermediate portion connecting the front and rear edge portions of the splitter blade, said splitter blades and said full blade being alternately arranged with substantially equal spaces along a rotating direction of the disc member, wherein each of said splitter blade has an extension blade formed integrally with the protruded intermediate portion of the splitter blade having an edge portion inclining from a top of the protruded intermediate portion near the front edge portion of the splitter blade to a portion near the outer peripheral portion of the hub.

2. The splitter-type impeller according to claim 1, wherein each of said extension blade has a shape identical to the full blade adjacent to the splitter blade with a triangular cutback.

* * * * *